US009330610B2

(12) United States Patent
An et al.

(10) Patent No.: US 9,330,610 B2
(45) Date of Patent: May 3, 2016

(54) LIQUID CRYSTAL DISPLAY DEVICE INCLUDING A BACKLIGHT UNIT EMPLOYING A LIGHT SOURCE AND METHOD FOR DRIVING THE SAME

(75) Inventors: Jung Nam An, Pyeongtaek-si (KR); Min Ho Kim, Pyeongtaek-si (KR); Chan Sung Jeong, Pyeongtaek-si (KR); Seung Se Kim, Pyeongtaek-si (KR); Hoon Hur, Pyeongtaek-si (KR); Won Do Kee, Pyeongtaek-si (KR)

(73) Assignee: LG ELECTRONICS INC., Seoul (KR)

( * ) Notice: Subject to any disclaimer, the term of this patent is extended or adjusted under 35 U.S.C. 154(b) by 199 days.

(21) Appl. No.: 13/380,708

(22) PCT Filed: Apr. 30, 2010

(86) PCT No.: PCT/KR2010/002763

§ 371 (c)(1),
(2), (4) Date: Dec. 23, 2011

(87) PCT Pub. No.: WO2010/150974

PCT Pub. Date: Dec. 29, 2010

(65) Prior Publication Data

US 2012/0105507 A1 May 3, 2012

(30) Foreign Application Priority Data

Jun. 26, 2009 (KR) ..... 10-2009-0057553

(51) Int. Cl.
*G09G 3/36* (2006.01)
*G09G 3/34* (2006.01)

(52) U.S. Cl.
CPC ..... *G09G 3/3426* (2013.01); *G09G 3/3611* (2013.01); *G09G 2320/0233* (2013.01); *G09G 2320/0606* (2013.01);

(Continued)

(58) Field of Classification Search
USPC ..... 345/102, 690, 89
See application file for complete search history.

(56) References Cited

U.S. PATENT DOCUMENTS

| | | | | |
|---|---|---|---|---|
| 2006/0238487 | A1 | 10/2006 | Shih | 345/102 |
| 2007/0247871 | A1 * | 10/2007 | Yoo | 362/612 |
| 2007/0296886 | A1 | 12/2007 | Inada et al. | 349/61 |

(Continued)

FOREIGN PATENT DOCUMENTS

| | | | |
|---|---|---|---|
| CN | 1967643 | A | 5/2007 |
| EP | 1 788 550 | A1 | 5/2007 |

(Continued)

OTHER PUBLICATIONS

International Search Report dated Dec. 14, 2010 issued in Application No. PCT/KR2010/002763.

(Continued)

*Primary Examiner* — Long D Pham
(74) *Attorney, Agent, or Firm* — KED & Associates, LLP

(57) ABSTRACT

The present invention relates to a liquid crystal display device in which the light sources of a backlight unit are independently driven as a plurality of separate regions, and to a drive method for the same. In situations where there is a substantial variation in the brightness (luminance) of regions being displayed on the liquid crystal display device, the present invention can improve the visibility of boundaries due to differences in luminance in images displayed within the regions of the backlight unit emitting light at different levels of luminance as a result.

18 Claims, 7 Drawing Sheets

(52) U.S. Cl.
CPC ..... *G09G 2320/0626* (2013.01); *G09G 2320/0646* (2013.01); *G09G 2360/16* (2013.01)

(56) References Cited

U.S. PATENT DOCUMENTS

| | | | | |
|---|---|---|---|---|
| 2008/0111784 | A1 | 5/2008 | Tanaka et al. | 345/102 |
| 2008/0136767 | A1* | 6/2008 | Kim et al. | 345/101 |
| 2009/0002310 | A1* | 1/2009 | Kawaguchi et al. | 345/102 |
| 2009/0140665 | A1* | 6/2009 | Park | 315/291 |
| 2009/0140975 | A1 | 6/2009 | Nonaka et al. | 345/102 |
| 2009/0174636 | A1* | 7/2009 | Kohashikawa et al. | 345/87 |
| 2009/0243980 | A1* | 10/2009 | Nakai et al. | 345/84 |
| 2009/0290091 | A1* | 11/2009 | Tsuchida et al. | 349/61 |
| 2010/0020005 | A1* | 1/2010 | Jung et al. | 345/102 |

FOREIGN PATENT DOCUMENTS

| | | | |
|---|---|---|---|
| EP | 1 890 280 A2 | | 2/2008 |
| KR | 10-2005-0112661 A | | 12/2005 |
| KR | 10-2008-0016108 A | | 2/2008 |
| KR | 10-2008-0050339 A | | 6/2008 |
| KR | 10-2008-0067843 A | | 7/2008 |
| KR | 10-2008-0073821 A | | 8/2008 |
| KR | 10-2010-0106703 A | | 10/2010 |
| WO | WO 2007/091505 | * | 8/2007 |

OTHER PUBLICATIONS

European Search Report dated Jan. 16, 2013 issued in Application No. 10 79 2256.9.

Chinese Office Action issued in Application No. 201080028566.5 dated Jul. 29, 2014.

Korean Notice of Allowance issued in Application No. 10-2009-0057553 dated Aug. 26, 2015 (with English Translation).

* cited by examiner

| | | | | | | |
|---|---|---|---|---|---|---|
| 100 | 100 | 100 | 100 | 100 | 100 | 100 |
| 100 | 100 | 100 | 100 | 100 | 100 | 100 |
| 100 | 100 | 255 | 255 | 255 | 100 | 100 |
| 100 | 100 | 255 | 255 | 255 | 100 | 100 |
| 100 | 100 | 255 | 255 | 255 | 100 | 100 |
| 100 | 100 | 100 | 100 | 100 | 100 | 100 |
| 100 | 100 | 100 | 100 | 100 | 100 | 100 |

(a)

(b)

| | | | | | | |
|---|---|---|---|---|---|---|
| 100 | 100 | 100 | 100 | 100 | 100 | 100 |
| 100 | 110 | 129 | 139 | 129 | 110 | 100 |
| 100 | 129 | 187 | 216 | 187 | 129 | 100 |
| 100 | 139 | 216 | 255 | 216 | 139 | 100 |
| 100 | 129 | 187 | 216 | 187 | 129 | 100 |
| 100 | 110 | 129 | 139 | 129 | 110 | 100 |
| 100 | 100 | 100 | 100 | 100 | 100 | 100 |

FIG. 8

| | | |
|---|---|---|
| 1/16 | 2/16 | 1/16 |
| 2/16 | 4/16 | 2/16 |
| 1/16 | 2/16 | 1/16 |

LIQUID CRYSTAL DISPLAY DEVICE INCLUDING A BACKLIGHT UNIT EMPLOYING A LIGHT SOURCE AND METHOD FOR DRIVING THE SAME

CROSS-REFERENCE TO RELATED PATENT APPLICATIONS

This application is a U.S. National Stage Application under 35 U.S.C. §371 of PCT Application No. PCT/KR2010/002763, filed Apr. 30, 2010, which claims priority to Korean Patent Application No. 10-2009-0057553, filed Jun. 26, 2009.

TECHNICAL FIELD

The present invention relates to a liquid crystal display device and a method for driving the same. In particular, the invention relates to a liquid crystal display device including a backlight unit employing a plurality of light-emitting diodes and a method for driving the same.

BACKGROUND ART

Generally, among display devices, a liquid crystal display (LCD) device has been used in a variety of devices including a television, a laptop computer, a monitor for a desktop computer and a mobile telephone.

Since such a liquid crystal display device is not of a self-luminous type, it requires a light-emitting unit to irradiate a liquid crystal display panel in displaying an image.

The light-emitting unit of the liquid crystal display device is called a backlight unit because it is disposed on a rear face of a liquid crystal display panel. The backlight unit forms uniform surface light and supplies it to the panel.

A conventional backlight unit includes a light source, a light guide plate, a diffusion sheet, a prism, a protection sheet, etc. and may generally employ as the light source a fluorescent lamp such as a mercury cold cathode fluorescent lamp or a light-emitting diode.

DISCLOSURE

Technical Problem

An object of the present invention is to provide a liquid crystal display device including a backlight unit using LEDs and being driven in a divisional manner in which a visibility of a boundary between regions with different brightness (luminance) values may be suppressed by optimizing the brightness (luminance) difference, and is also to provide a method of driving the same.

Technical Solution

In accordance with one aspect of the invention, provided is a liquid crystal display device including a region luminance extraction unit to extract a first luminance value being a luminance value of each of regions in an input image, a region luminance optimization unit to increase or decrease the first luminance value by a given increment or decrement so as to reduce luminance differences between regions adjacent to each other and to output a resultant second luminance value, a drive unit to independently drive a light source of a backlight unit for individual ones of the regions using the second luminance value, and an image signal processing unit to compensate the first luminance value based on the second luminance value.

The liquid crystal display device may further include a user interface to output a setting menu for setting the given increment or decrement.

The user interface may receive a setting key signal input in accordance with the setting menu.

The liquid crystal display device may further include a control unit to control the region luminance optimization unit so that the given increment or decrement set based on the setting key signal is applied to the first luminance value and thus the second luminance value is output.

The user interface may output an OSD (On Screen Display) for determining whether or not to increase or decrease the first luminance value by the given increment or decrement and thus output the second luminance value.

The region luminance optimization unit may perform contrast ratio adjustment, histogram equalization or spatial filter application so as to reduce the luminance difference between adjacent regions and thus output the second luminance value.

The spatial filter application may include 3×3 spatial filter masking to optimize one unit region and 8 unit regions surrounding one unit region.

The image signal processing unit may compensate the first luminance value so that a difference between the first and second luminance values decreases.

The image signal processing unit may compensate the first luminance value by comparing the first luminance value in a given region with a luminance value of a region of the backlight unit corresponding to the given region, and by increasing or decreasing the first luminance value if the first luminance value in the given region and the luminance value of the region of the backlight unit corresponding to the given region are different.

The light source may include a plurality of LEDs disposed along at least one side of a plurality of light guide plates arranged adjacent to one another.

The unit regions may correspond to the light guide plates respectively.

In accordance with another aspect of the invention, provided is a method of driving a liquid crystal display device. The method includes extracting a first luminance value being a luminance value of each of regions in an input image, extracting a second luminance value by increasing or decreasing the first luminance value by a given increment or decrement so as to reduce luminance difference between adjacent regions, independently driving a light source of a backlight unit for individual ones of the regions using the second luminance value, and compensating the first luminance value based on the second luminance value.

Advantageous Effects

Advantageous effects of the invention are as follows.

Although there is a great difference in luminance (brightness) between regions in the image displayed from the liquid crystal display device where light sources of the backlight unit are driven in a divisional manner, a visibility of the boundary between the regions in the image due to the luminance difference may be suppressed.

When using the backlight unit having the light guide plates arranged in an adjacent way, visibility of a boundary between the light guide plates due to a luminance (brightness) difference between the light-emitting regions, that is, the light guide plates may be suppressed.

Local dimming capable of locally adjusting brightness of the image may be more effectively applied to the liquid crystal display device, resulting in a display of a picture with a high contrast ratio and a great reduction of a power consumption by the backlight unit.

DESCRIPTION OF DRAWINGS

FIG. 8 shows one example of a 3×3 spatial filter.

BEST MODE

Below, embodiments of the invention will be described in detail with reference to the accompanying drawings.

Reference will now be made in detail to the exemplary embodiments of the present invention, examples of which are illustrated in the accompanying drawings. The detailed description, which will be given below with reference to the accompanying drawings, is intended to explain exemplary embodiments of the present invention, rather than to show the only embodiments that can be implemented according to the invention. The following detailed description includes specific details in order to provide a thorough understanding of the present invention. However, it will be apparent to those skilled in the art that the present invention may be practiced without such specific details. For example, the following description will be given centering on specific terms, but the present invention is not limited thereto and any other terms may be used to represent the same meanings.

When an element such as a layer, region or substrate is disposed "on" another element herein, this means that the former may be in direct or indirect contact with the latter.

Figure 1:
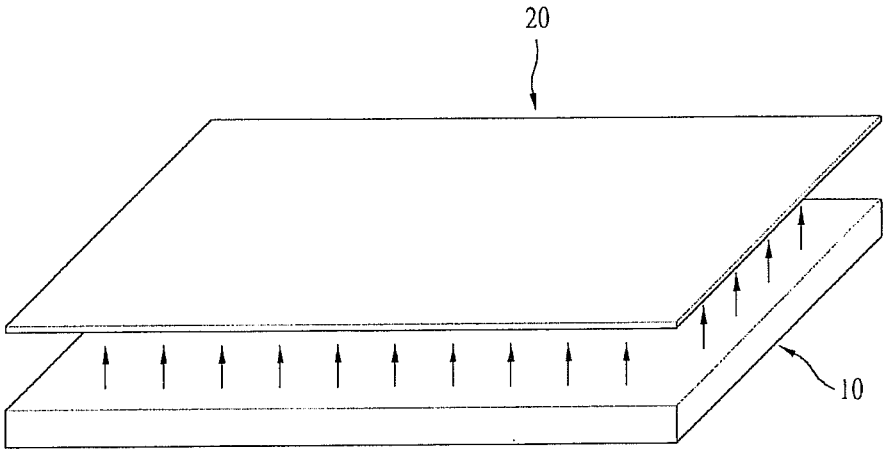
FIG. 1 is a schematic view of one example of a liquid crystal display device.

A liquid crystal display module includes, as shown in FIG. 1, a backlight unit 10 as a light-emitting unit and a liquid crystal panel 20 disposed as a display unit on the backlight unit 10.

Figure 2:
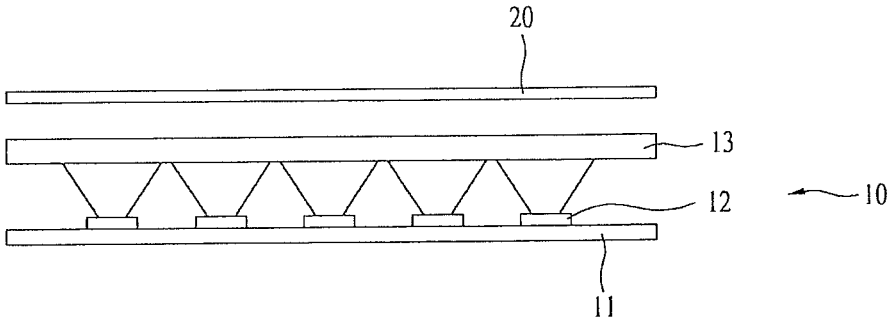
FIG. 2 is a schematic view of one example of a direct-lighting type backlight unit.
Figure 3:
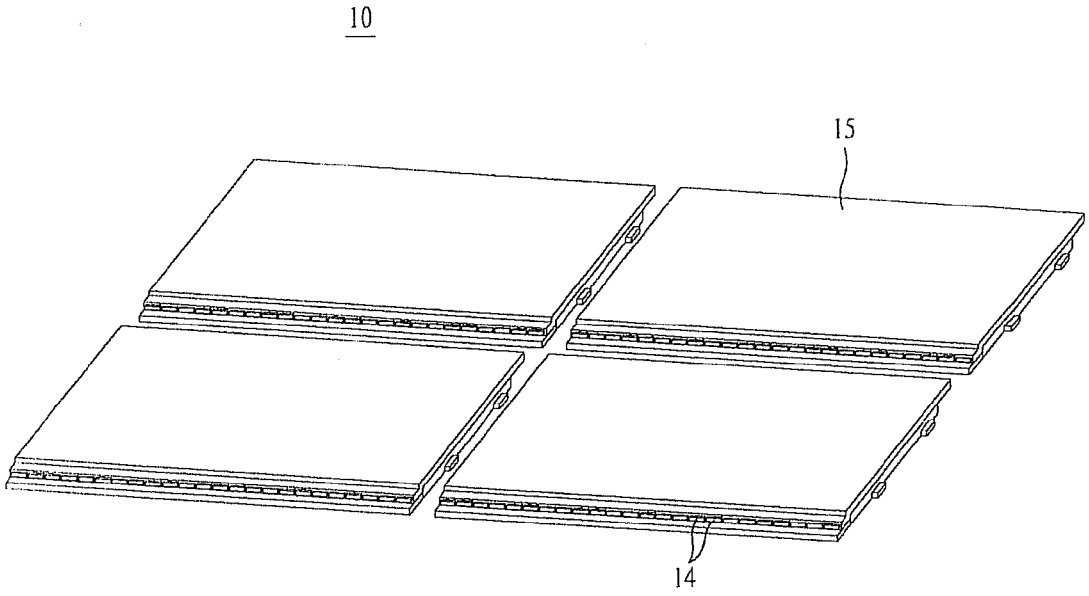
FIG. 3 is a schematic view of one example of a backlight unit employing a light guide plate.

The backlight unit 10 may use LEDs as a light source and, in this case, may be of a direct-lighting type as shown in FIG. 2 or a light guide plate type as shown in FIG. 3.

In the direct-lighting type backlight unit of FIG. 2, a plurality of LEDs 12 is arranged on a circuit board 11 and light emitted from the LEDs 12 is irradiated through an optical sheet 13 to the liquid crystal panel 20.

In the light guide plate type backlight unit of FIG. 3, a plurality of light guide plates 15 is arranged adjacent to one another and coupled to one another. LEDs 14 are disposed along one side of each light guide plate 15.

Using the backlight unit 10 having an array of plural LEDs 12 or 14, it may be possible to independently adjust brightness of each display region in accordance with an image to be displayed in driving the liquid crystal display module.

Thus, when using such a backlight unit structure enabling divisional driving thereof, local dimming capable of locally adjusting brightness of an image to be displayed may be accomplished by locally driving the LED light sources in a divisional manner on the basis of the image. As a result, a picture with a high contrast ratio may be displayed and power consumption of the backlight unit may be greatly reduced.

The divisional driving may be carried out in such a manner that the LEDs 12 or 14 are individually driven. Alternatively, the LEDs 12 or 14 may be logically grouped to be driven in a divisional manner for individual groups.

The light guide plate type backlight unit of FIG. 3 may be driven in a divisional manner for the entirety of all LEDs disposed on each light guide plate 15 or for a part of the LEDs disposed on each light guide plate 15. Otherwise, a combination of a part of the LEDs 14 disposed on one light guide plate 15 and a part of the LEDs 14 disposed on another light guide plate adjacent to the former light guide plate 15 may be set as a unit for divisional driving.

Figure 4:
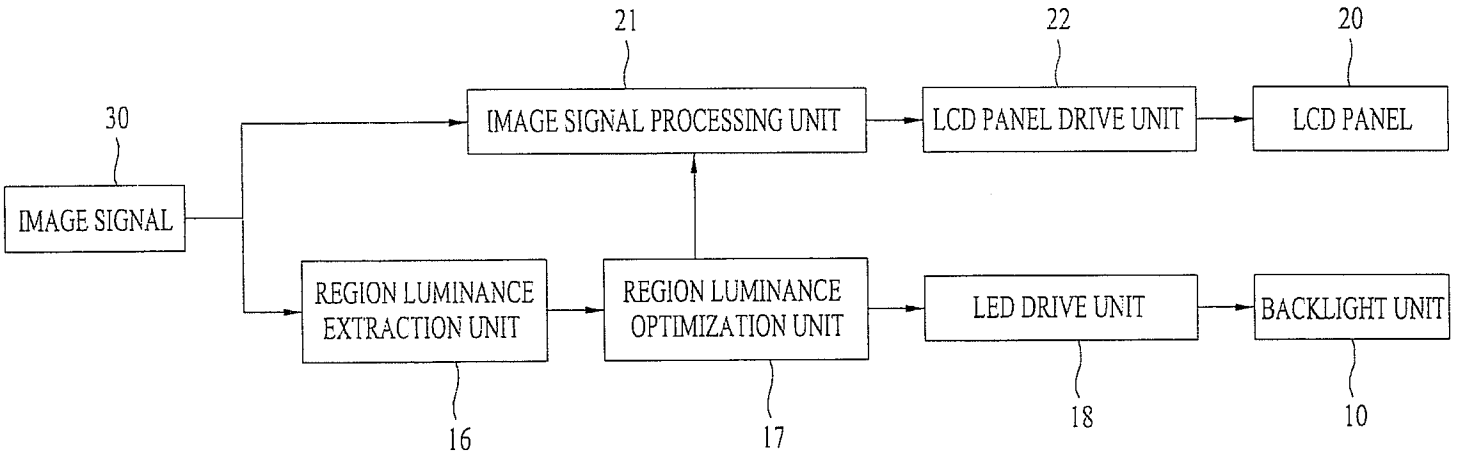
FIG. 4 is a block diagram of image processing of a television including the liquid crystal display device.

The driving of the liquid crystal panel 20 and backlight unit 10 in the above-described manner may be achieved using image processing as illustrated in FIG. 4. This image processing in FIG. 4 is set forth with reference to, as an example, a television set employing a liquid crystal display device.

An image signal 30 to be displayed from the liquid crystal display device is input, in a branched manner, to a LED drive unit 18 for driving the LEDs and an image signal processing unit 21. The signal processed at the image signal processing unit 21 is input to an LCD panel drive unit 22 for driving the LCD panel 20. The image signal has a first luminance value.

Display of the image signal from the LCD panel 20 by the panel drive unit 22 is carried out using the light emitted from the backlight unit 10 including an array of the LEDs formed using the LED drive unit 18.

Now, how to achieve the local dimming using such image processing will be described. The image signal 30 is output through the image signal processing unit 21 to the LCD panel 20 and, at the same time, the LEDs in the backlight unit 10 are driven by the LED drive unit in a divisional manner 18 depending on a brightness condition of the image signal 30.

To be specific, when the image signal 30 includes a dark image in its entirety or in a portion thereof, the LED drive unit 18 drives the LEDs of the backlight unit so that among divided regions of the liquid crystal display panel 20, the LEDs corresponding to the region of the liquid crystal display panel 20 to display the dark image are turned off or become dark.

Conversely, when the image signal 30 includes a bright image, the LED drive unit 18 drives the LEDs of the backlight unit so that among divided regions of the liquid crystal display panel 20, the LEDs corresponding to the region of the liquid crystal display panel 20 to display the bright image are turned off or become brighter.

Thus, display of a picture with a high contrast ratio may be enabled.

When, however, the backlight unit is driven in a divisional manner, there may appear the following problems. When, in one example, there is a great difference in luminance between displayed image regions, a boundary between the regions may be visible in the displayed image due to the luminance difference.

In another example, namely in the backlight unit of FIG. 3 in which adjacent ones of the light guide plates are coupled, a boundary between the adjacent light guide plates may also be visible in the displayed image.

Therefore, according to embodiments, such a phenomenon may be suppressed by extracting, from the input image signal, a luminance value of each of regions in the backlight unit, reducing a luminance difference between the regions using various image processing approaches, and compensating the image signal based on the resultant luminance value of the backlight unit. The extracted luminance value of each region may become the above-mentioned first luminance value. The various image processing approaches may include contrast ratio adjustment, histogram equalization, spatial filter application, etc.

That is, the liquid crystal display device may include a region luminance extraction unit 16 for extracting the input image signal 30 a luminance value of each of divisional driving regions in the backlight unit 10, and a region luminance optimization unit 17 for spatially optimizing the extracted luminance value so as to reduce luminance differences between the divisional driving regions. Thus, the backlight unit 10 may be driven by the LED drive unit 18 based on the optimized luminance value.

Further, the image signal processing unit 21 may compensate the image signal based on the optimized luminance value of the backlight unit 10 and drive the LCD panel 20 using the panel drive unit 22 using the compensated image signal.

This inventive approach will be described below in detail.

First, the region luminance extraction unit 16 extracts, from the input image signal 30, the luminance value of each of the divisional driving regions in the backlight unit 10. The extracted luminance value of each region becomes the above-mentioned first luminance value.

The region luminance optimization unit 17 spatially optimizes the extracted luminance value to reduce luminance differences between the divisional driving regions in the backlight unit 10. Optimization may include contrast ratio adjustment, histogram equalization, spatial filter application, etc.

Then, each region of the backlight unit 10 is driven by the LED drive unit 18 based on the optimized luminance value. At this time, the image signal processing unit 21 compensates the image signal based on the optimized luminance value.

A process of optimizing the luminance value of the backlight unit 10 when driving the backlight unit in a divisional manner will be described in detail below with reference to FIG. 4 to FIG. 8.

Figure 5:
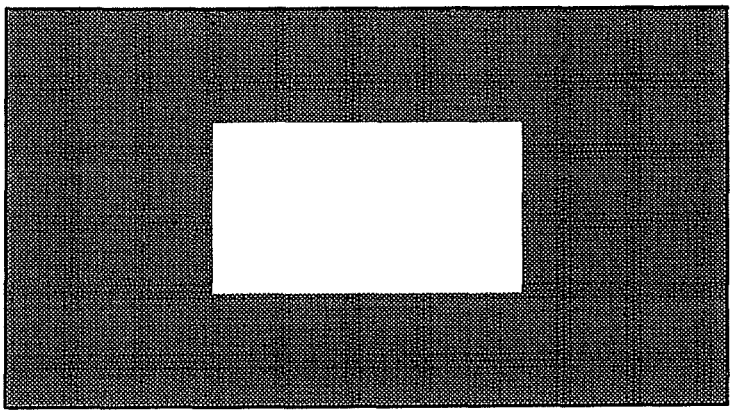
FIG. 5 is a schematic view of one example of an input image.
Figure 6:
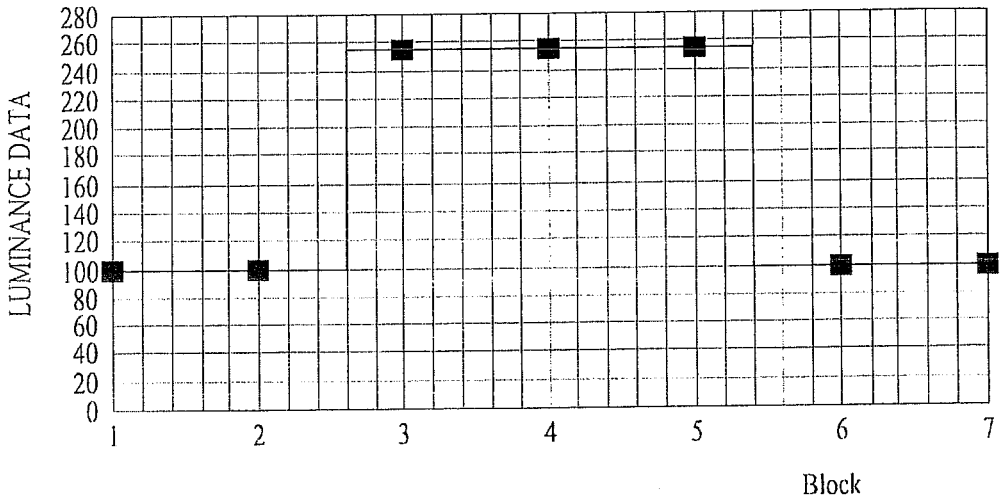
FIG. 6*a* and FIG. 6*b* are a view and graph illustrating an extracted luminance of each region respectively.
Figure 7:
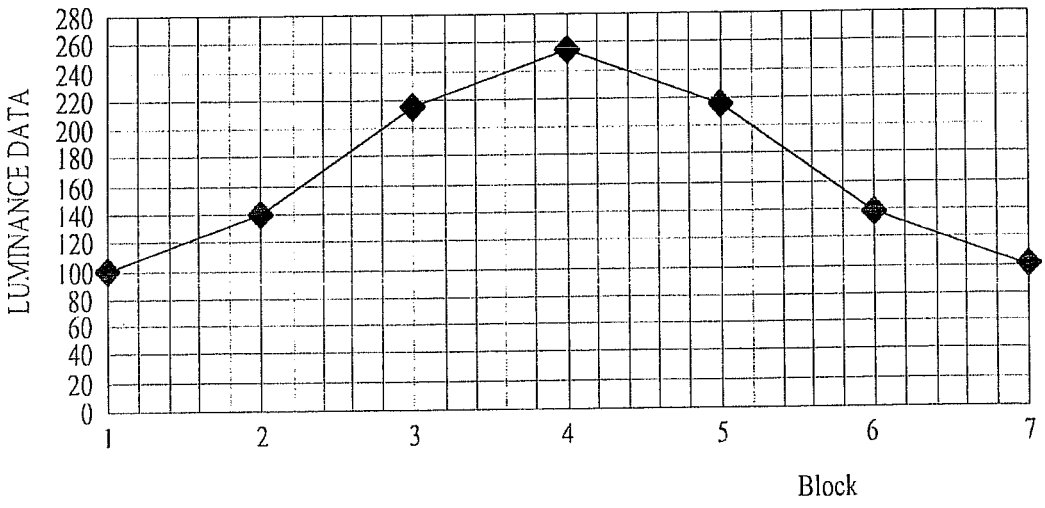
FIG. 7*a* and FIG. 7*b* are a view and graph illustrating a luminance of each region resulting from spatial filter application respectively.

First, when an image as illustrated in FIG. 5 is input, the region luminance extraction unit 16 extracts, as shown in FIG. 6*a* and FIG. 6*b*, a luminance value of each region in the input image. The extracted luminance value of each region may be an average value of maximums of red, green and blue colors between pixels in each region or may be an average value of luminance values between pixels in each region.

The region luminance optimization unit 17 spatially optimizes the extracted luminance value of each region using the above-mentioned contrast ratio adjustment histogram equalization or spatial filter application so as to reduce luminance differences between the divisional driving regions of the backlight unit 10. The optimized luminance value of each region is sent to the LED drive unit 18 which in turn drives the backlight unit for individual regions based on the optimized luminance value.

Each region illustrated in FIG. 6*a* and FIG. 6*b* may be an individual driving region of the backlight unit as shown in FIG. 2 or FIG. 3 or may correspond to a light guide plate module including one light guide plate in the backlight unit as in FIG. 3.

FIG. 7*a* and FIG. 7*b* show an example of a result of applying 3×3 spatial filter masking as illustrated in FIG. 8 among the above-mentioned image processing approaches for optimization of the luminance. This spatial filter is a filter mask which optimizes one unit region and 8 unit regions surrounding one unit region. Spatial filer masking having another configuration may also be used. One example of such a spatial filter may be a filter controlling transmittances of spatial frequency components having an image per component. This type of filter processes the image by overlapping the transmittances per spatial frequency component.

The region luminance optimization unit 17 increases or decreases the luminance value (as illustrated in FIG. 6*a*) of each region in an original image signal by a given increment or decrement so as to reduce the luminance differences between the divisional driving regions of the backlight unit 10 and then outputs the resultant optimized luminance value (as illustrated in FIG. 7*a*) of each region. A spatial optimization method capable of reducing the luminance differences between the regions of the backlight unit 10 may include the above-mentioned contrast ratio adjustment, histogram equalization, spatial filter application, etc.

A setting menu for setting the given increment or decrement may be output using a user interface (not shown). The user interface may receive a setting key signal set in accordance with to the setting menu via a user's remote control. A control unit (not shown) included in a liquid crystal display device may control the unit 17 so that the set given increment or decrement is applied to the first luminance value (the extracted luminance value of each region using the region luminance extraction unit 16) and hence the optimized luminance value (the luminance value output from the region luminance optimization unit 17) is produced. Such a given increment or decrement becomes apparent from differences between the luminance values indicated in FIG. 6*a* and FIG. 7*a* respectively.

The user interface (not shown) may output an OSD (On Screen Display) for determining whether to or not to increase or decrease the first luminance value by the given increment or decrement and thus output the optimized luminance value.

At this time, when there is a difference between the luminance value of the backlight unit 10 calculated using the region luminance optimization unit 17 and an actual luminance value of the image signal, the image signal should be compensated to reduce such difference.

To this end, the image signal processing unit 21 compares a luminance value of an image pixel of interest with a luminance value of a region of the backlight unit 10 corresponding to the image pixel. When the former is higher than the latter, the image signal processing unit 21 increases a transmittance of the image pixel (that is, increases an image signal value of the pixel) to increase the luminance of the image pixel.

Meanwhile, when the luminance value of the image pixel is lower than the luminance value of the region of the backlight unit 10 corresponding to the image pixel, the image signal processing unit 21 decreases a transmittance of the image pixel (that is, decreases an image signal value of the pixel) to decrease the luminance of the pixel.

In this way, the difference between the luminance value of the backlight unit 10 calculated from the region luminance optimization unit 17 and the actual luminance value of the image signal may be compensated.

According to the above process, although as described above, there is a great difference in luminance (brightness) between the displayed image regions in the liquid crystal display device, the visibility of the boundary between the regions in the image due to the luminance difference may be suppressed.

Further, when using the backlight unit having, as shown in FIG. 3, the light guide plates arranged in an adjacent way, not only may the visibility of the boundary between the light guide plates due to luminance (brightness) difference between the light-emitting regions, that is, the light guide plates, be suppressed, but also luminance (brightness) difference between the light guide plates may be minimized.

Consequently, the local dimming capable of locally adjusting brightness of an image may be more effectively applied to the liquid crystal display device, resulting in display of a picture with a high contrast ratio and a great reduction in the power consumption by the backlight unit.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A liquid crystal display device comprising:

a backlight unit comprising a plurality of light sources, wherein one or a group of the light sources correspond to a region, wherein the backlight unit comprises a plurality of regions, each of the plurality of regions being an individual driving region of the backlight unit; and wherein the plurality regions correspond to respective light guide plate modules;

a liquid display panel disposed on the backlight unit;

a region luminance extraction unit to extract a first luminance value being a luminance value of each of regions in an input image for display on the liquid display panel;

a region luminance optimization unit to increase or decrease the first luminance value of a first region by a given increment or decrement so as to output a resultant second luminance value of the first region, wherein the region luminance optimization unit performs spatial filter application;

a backlight drive unit to independently drive the individual light guide plate modules by driving the light source of the backlight unit for individual ones of the regions using the second luminance value;

an image signal processing unit coupled to the region luminance optimization unit to receive the second luminance value from the region luminance optimization unit, and configured to compare a luminance value of an image pixel with the second luminance value of a corresponding region of the backlight unit to compensate an image signal for driving the liquid display panel, and a display panel drive unit coupled to the liquid display panel to drive the liquid display panel with the compensated image signal, wherein the spatial filter application is configured to calculate the second luminance value of the first region to be a sum of products of the first luminance value and a respective predetermined coefficient for each of the first region and regions that surround the first region, the predetermined coefficient for adjacent ones of the regions that surround the first region being different from each other, and wherein a sum of the predetermined coefficient of the first region and the predetermined coefficients of each of the regions that surround the first region is 1.

2. The device according to claim 1, further comprising:

a user interface to output a setting menu for setting the given increment or decrement.

3. The device according to claim 2, wherein the user interface receives a setting key signal input correspondingly to the setting menu.

4. The device according to claim 3, further comprising:

a control unit to control the region luminance optimization unit so that the given increment or decrement set based on the setting key signal is applied to the first luminance value and hence the second luminance value is output.

5. The device according to claim 1, wherein the user interface outputs an OSD (On Screen Display) for determining whether to increase or decrease the first luminance value by the given increment or decrement in order to output the second luminance value.

6. The device according to claim 1, wherein the spatial filter application includes 3×3 spatial filter masking to optimize one unit region and 8 unit regions surrounding the one unit region.

7. The device according to claim 1, wherein the image signal processing unit compensates the image signal so that a difference between the first and second luminance values decreases.

8. The device according to claim 7, wherein the image signal processing unit compensates the image signal by comparing the first luminance value in a given region with a luminance value of a region of the backlight unit corresponding to the given region, and increasing or decreasing the first luminance value if the first luminance value in the given region and the luminance value of the region of the backlight unit corresponding to the given region are different.

9. The device according to claim 1, wherein the light source comprises a plurality of LEDs disposed along at least one side of the plurality of light guide plates arranged adjacent to one another.

10. The device according to claim 1, wherein the compensation of the image signal based on the second luminance value includes a suppression of visibility of the boundary between the light guide plate modules.

11. The device according to claim 1, wherein each of the plurality of regions is an individual driving region of the backlight unit such that each of the light guide plate modules is a unit that is independently driven.

12. A method of driving a liquid crystal display device, comprising:

extracting a first luminance value being a luminance value of a region in an input image, and wherein the light guide plate module is provided with one or a group of the light sources, and wherein the backlight unit comprises a plurality of regions, each of the plurality of regions being an individual driving region of the backlight unit and wherein the plurality regions correspond to the respective light guide plate modules;

extracting a second luminance value that is increasing or decreasing the first luminance value by a given increment or decrement so as to reduce luminance difference between adjacent regions, wherein extracting the second luminance value includes spatial filter application for spatially optimizing the first luminance value;

independently driving the plurality of light sources of the backlight unit for individual ones of the regions using the second luminance value, wherein the luminance of the backlight unit is controlled as a unit of the light guide plate module; and receiving the second luminance value that is optimized to drive the plurality of light sources of the backlight unit and comparing a luminance value of an image pixel with the second luminance value of a corresponding region of the backlight unit to compensate an image signal for driving a liquid display panel, wherein the spatial filter application is configured to calculate the second luminance value of a first region to be a sum of products of the first luminance value and a respective predetermined coefficient for each of the first region and regions that surround the first region, the predetermined coefficient for adjacent ones of the regions that surround the first region being different from each other, and wherein a sum of the predetermined coefficient of the first region and the predetermined coefficients of each of the regions that surround the first region is 1.

13. The method according to claim 12, further comprising:

outputting, through a user interface, a setting menu for setting the given increment or decrement.

14. The method according to claim 13, further comprising:

receiving, through the user interface, a setting key signal input correspondingly to the output setting menu.

15. The method according to claim 14, wherein extracting the second luminance value comprises applying the given increment or decrement set based on the setting key signal to the first luminance value and outputting the second luminance value.

16. The method according to claim 12, further comprising:

outputting an OSD (On Screen Display) for determining whether to increase or decrease the first luminance value by the given increment or decrement in order to output the second luminance value.

17. The method according to claim 12, wherein compensating the image signal is performed by spatially optimizing the first luminance value if the first luminance value in a given region and a luminance value of a region of the backlight unit corresponding to the given region are different.

18. The device according to claim 12, wherein the compensating the image signal based on the second luminance value includes a suppression of visibility of the boundary between the light guide plate modules.

* * * * *